United States Patent [19]

Peter et al.

[11] 4,254,571

[45] Mar. 10, 1981

[54] CARTRIDGE LOAD FOR A REVOLVER

[76] Inventors: Kurt Peter, Donaustrasse 101/12, A-2344 Maria Enzersdorf, Südstadt; Gerhard Muck, Peter-Jordan-Strasse 159, A-1180 Wien, both of Austria

[21] Appl. No.: 52,318

[22] Filed: Jun. 26, 1979

[30] Foreign Application Priority Data

Nov. 29, 1978 [AT] Austria ..... 8543/78

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 913,393 | 2/1909 | Kellogg | 42/89 |
| 1,969,817 | 8/1934 | Milmore | 42/89 |
| 1,971,526 | 8/1934 | Kempf | 42/89 |
| 3,213,559 | 10/1965 | Matich | 42/89 |

FOREIGN PATENT DOCUMENTS

| | | | |
|---|---|---|---|
| 2259610 | 6/1974 | Fed. Rep. of Germany | 42/89 |

*Primary Examiner*—Charles T. Jordan
*Attorney, Agent, or Firm*—Montague & Ross

[57] ABSTRACT

A loading device for the rounds or cartridges of a revolver comprises a generally circular array of pockets receiving the individual cartridges and a ring which can be grasped by a finger to draw the loading device away from the cartridges. The unitary device has a closed cartridge ring, which can be injection molded around the cartridges and has the finger ring disposed at one side, is provided with at least one weakened zone. The weakened zone enables the cartridge ring to readily spread open. The pockets for the cartridges preferably open inwardly toward the axis.

13 Claims, 6 Drawing Figures

CARTRIDGE LOAD FOR A REVOLVER

FIELD OF THE INVENTION

Our present invention relates to a cartridge load for a revolver and to a device facilitating the loading of a revolver by holding the cartridges thereof in a predetermined spaced apart relationship.

BACKGROUND OF THE INVENTION

It has been proposed to provide cartridge loads or packages for a revolver in which, in one case, a ring is formed with a plurality of pockets each of which is adapted to receive a cartridge casing so that the bullets of the respective rounds project in one direction and can be inserted into the chamber of the revolver drum.

This ring can be preloaded with the cartridges so that, upon the complete firing of the cartridges of the revolver, the spent cartridges can be removed as a unit and a fresh package of cartridges inserted as a unit. This affords rapid loading of the weapon in this case, the ring remains in place around the cartridges and generally speaking, the drum of this revolver or the ejector mechanism or other elements of the weapon must be accommodated to the use of this loading ring.

It has also been proposed (see U.S. Pat. No. 3,213,559) to provide the loading package so that the loading device can be stripped from the cartridges as soon as they have been partially inserted into the drum of the revolver.

In this unit, the loading device is constituted as a strip or belt having pockets corresponding in number to the rounds, which may be received in the cylinder of the revolver, with a spacing between them corresponding to the spacing between these rounds.

For introduction of the rounds into the revolver cylinder, the belt or strip can be rolled so that the bullet ends of the cartridges can be inserted into the respective bores of the cylinder and the strip or belt is then drawn away to release the cartridges in succession so that the latter can be pressed further into the respective bores.

When the belt is rolled up, the pocket-defining webs can bear one upon another to ensure the cylindrical pattern of the package which is retained by providing one end of the belt with a tab and the other end of the belt with a loop engageable by the tab to retain the package in place. Thus, when reloading of the revolver is necessary, the projecting portions of the cartridges of the package are inserted into the respective cylinder bores and the cylinder swung out of its normal position in the revolver, the tab is tugged to release it, and the belt is pulled away in the manner previously described, thereby inducing the cylinder to rotate as each pocket releases the respective cartridge. Each released cartridge can be pressed into place or can fall into place.

The strip or belt can be reloaded at a later time.

The pockets generally engage the body of the cartridge casing, which is cylindrical, between the flange or rim and the bullet over a length which is at least sufficient to ensure parallelity of the cartridges in the loading package.

Loading packages of this latter type have various disadvantages which have been discovered with experience utilizing them. For example, the hook-and-eye closure of the package may be released in normal handling operations, causing the package to open and constituting a manipulation problem.

Frequently the hook-and-eye closure jams so that the belt or strip cannot readily be drawn off the cartridges.

In order to ensure an effective anchoring of the cartridges, it has been found necessary with the belt-type device described above to form the ends of the webs or partitions between the pockets with beads or thickened portions. These have a tendency to lock between the cartridges and must be drawn out with considerable force. There is a tendency, therefore, for the partitions to tear or the pockets to deform and become unusable even after a few reloading cycles.

Of course, if the partition tears in use, at least one of the two cartridges held thereby must be removed by hand and the piece of the partition dislodged before the cylinder can be swung back into its firing position.

Thus, the advantages of high speed loading with packages of cartridges can be completely defeated and a danger created to an officer who must have his revolver in firing readiness in an emergency situation.

OBJECTS OF THE INVENTION

It is the principal object of the present invention to provide an improved cartridge package for a revolver which is free from the disadvantages enumerated above, i.e. enables the rapid loading of the revolver without the danger that the loading package will delay reloading in the event of an emergency situation.

Another object of the invention is to provide an improved loading device which facilitates the loading of the cylinder of a revolver.

SUMMARY OF THE INVENTION

These objects and others which will become apparent hereinafter are attained, in accordance with the present invention, by providing the one-piece device as a closed ring having a grip on one side thereof and advantageously formed around the cartridges by injection molding to produce the load package, the ring having at least one weakened portion constituting a preferred break region which retains the ring in its closed position when the package is intact, but upon a tug on the grip, ruptures to allow the grip to withdraw the loading device as a unit and release the cartridges.

The pockets of the ring, constituting cartridge sets, are preferably open inwardly toward the axis.

BRIEF DESCRIPTION OF THE DRAWING

The above and other objects, features and advantages of the present invention will become more readily apparent from the following description, reference being made to the accompanying drawing, in which.

SPECIFIC DESCRIPTION

The cartridge package of the present invention can be used with a revolver whose cylinder or drum has a plurality of angularly equispaced bores each adapted to accommodate a respective cartridge and successively alignable with the barrel and hammer of the weapon. While the disks of the present invention have six pockets or seats in which respective cartridges are received and hence the cartridge package is adapted for use with a six-shot revolver, the number of such seats can vary depending upon the number of bores in the revolver cylinder.

Generally the revolver cylinder can be swung out for loading and unloading.

Figure 1:
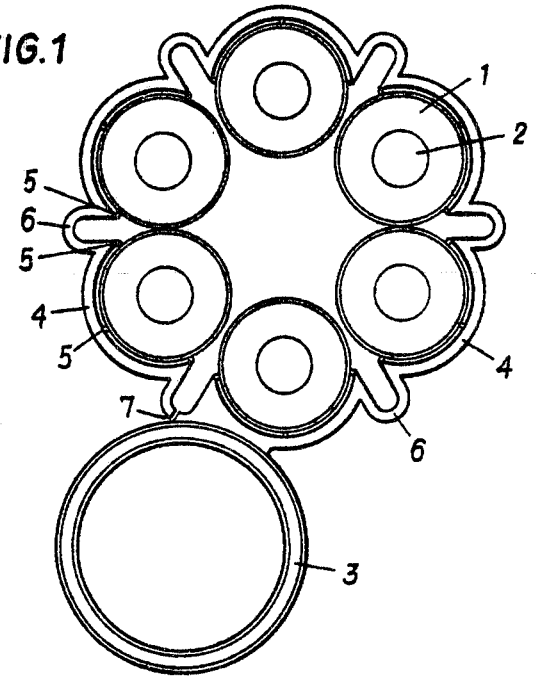
FIG. 1 is an elevational view of a cartridge package for a revolver in accordance with an embodiment of the invention, showing the ring injection molded about the cartridges.

In FIG. 1 six cartridges can be seen (from their bottom or rims 1) and have primers or percussion caps 2 adapted to be struck by the revolver hammer.

The cartridges are held in the package by a synthetic resin (e.g. polyethylene) ring or disk which, upon engagement by the user, can be pulled away as is the case with the loading strip or belt previously mentioned. More particularly, the one-piece or unitary synthetic resin disk is injection molded onto the cartridges and can be connected therewith at weakened or breakaway points 5 which also serve to connect the arcuate members extending partly around each cartridge and represented at 4, in an annular configuration. Another weakened zone in the form of a notch 7 is provided directly between a circular grip ring 3 and the other end of the synthetic resin element. Between the arcuate sections 4, outwardly bent U-shaped ligatures 6 are provided to allow slight expansion or contraction of the crown of cartridges of the package to accommodate various spacings of the bores of the revolver cylinder.

The grip 3 forms the transition between one of these arcuate members and a ligature at the weakening notch 7.

It will be apparent from FIG. 1 that the synthetic resin ring formed by the interconnected and alternating arcuate elements 4 and the bights or ligatures 6 is circumferentially continuous until the loading operation is commenced.

In loading the weapon the package shown in FIG. 1 is inserted into the rear of an outwardly swung cylinder of the revolver so that at least the bullet ends of each of the cartridges is received in a respective bore or cylinder, the insertion being perpendicular to the plane of the paper in FIG. 1.

The ring 3 is thereupon gripped and tugged away by the right hand while the weapon is held in the left hand, the grip being engaged between the thumb and ring finger. The weapon, which can also be a tilting-magazine revolver which can be broken open for reloading, is held with its barrel turned downwardly and the ring 3 is pulled away from the drum. The loading disc breaks first in the region of the notch 7, freeing the cartridge directly adjacent to grip ring 3 and allowing the arcuate portions 4 to be successively drawn away as the cylinder rotates, breaking away each of the weakened webs 5 connected to the cartridges. The cartridges then can drop or be pressed home into the respective bores. The grip and attached portions of the loading disk can then be discarded and the cylinder swung back into place.

Figure 2:
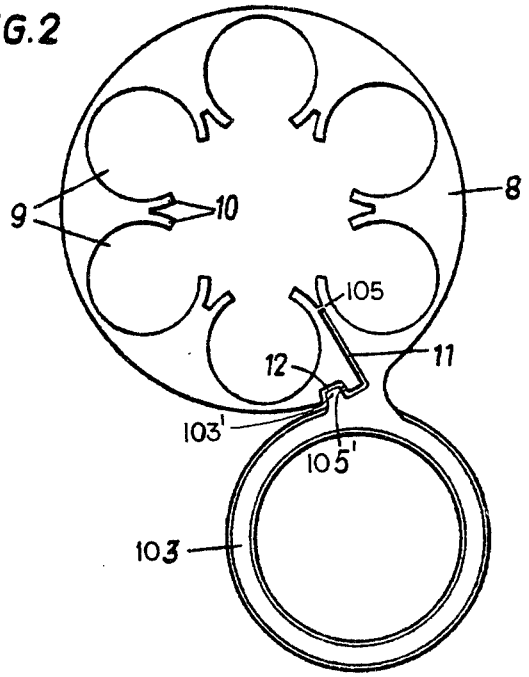
FIGS. 2–6 are similar views of other embodiments of the loading device, illustrating units into which the cartridges can be inserted or which can be injection molded onto the cartridges.

In FIG. 2 we have shown a loading disk which, as in FIG. 1, consists of two circumferentially continuous but interconnected rings, the one being the gripping ring 103 while the other is a ring 8 formed with internally open seats or pockets 9 in which the cartridges are accommodated. Although the cartridges have not been shown in FIG. 2, it will be understood that the ring 8 can be injection molded around the cartridges or formed by injection molding independently thereof, the cartridges being inserted axially into the respective pockets.

The ring 8 is formed with a split 11 which is bridged by a connecting web 105 forming a weakened zone at which the ring 8 can be broken apart.

The separating walls between the seats or pockets 9 are formed at their inner extremities with inwardly diverging lugs 10 to resiliently hold the cartridges in the respective pockets. The two lugs of each separating wall can be pressed to a collective width which does not exceed the smallest distance between neighboring cartridges. In FIG. 2 these ligatures are shown as they would lie in engagement with the cartridges.

The split 11 is formed in the partition wall closest to the ring 103 and extends into a recess or groove 12 of the cartridge ring 8. A projection 103' from the gripping ring extends slightly into the recess 12 and a further weakened web 105' bridges the wall of the recess and the projection.

The use of the device of FIG. 2 corresponds generally to that of FIG. 1 with a tug upon the grip ring 103 breaking first the web 105' and then the web 105 to enable the previously continuous cartridge ring 8 to distort into a belt configuration and be withdrawn from the cartridges. The lugs 10 upon withdrawal of the partition walls, are simply bent inwardly during this operation so that there is no danger of tearing. Since the pockets 9 are open inwardly and the cartridges are elastically held by the lugs 10, the cartridge package can be accommodated to various models of revolver as to different spacings of the cartridges.

FIGS. 3 through 6 show leading units of various configurations which have in common the fact that the gripping ring 203 may be drawn radially away from the package rather than tangentially as represented by the arrows A in these Figures. When the cartridge holder is turned away, therefore, no rotation of the cylinder is necessary or occurs.

Figure 3:
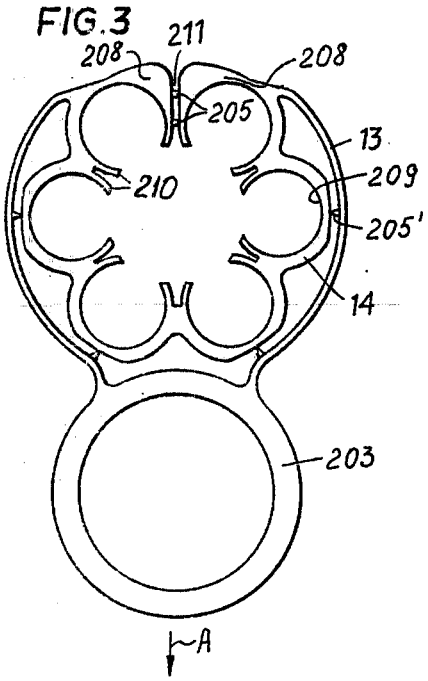

In the embodiment of FIG. 3, the ring is connected by two relatively thin ligatures 13 to a pair of arcuate seat-forming members 208 which are interconnected by the weakened webs 205 at a gap 211, the remaining seats being represented at 209. All of the seats and pockets are spaced apart by partition walls which, as in the embodiment of FIG. 2, have inwardly flaring resilient lugs 210. The inner walls 14 of the pockets 209 are connected to the ligatures 13 by intentional-rupture webs 205'. This embodiment can have the cartridges pressed into the seats or can be molded unitarily with the seats.

When the noses of the cartridges are inserted into the bores of the cylinder and the ring 203 is tugged, the webs 205, 205' rupture, members 208 are pulled apart at the gap 211 and the loading device is withdrawn from the array of cartridges.

Figure 4:
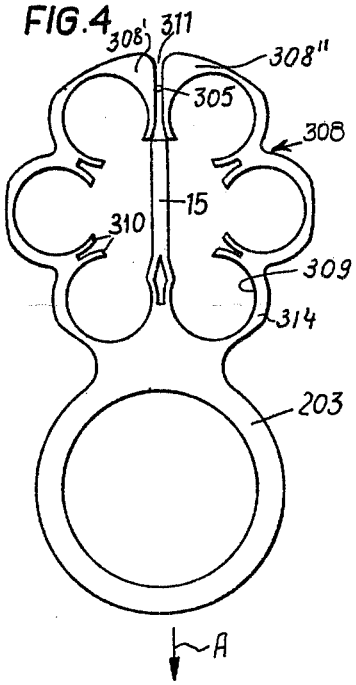
Figure 5:
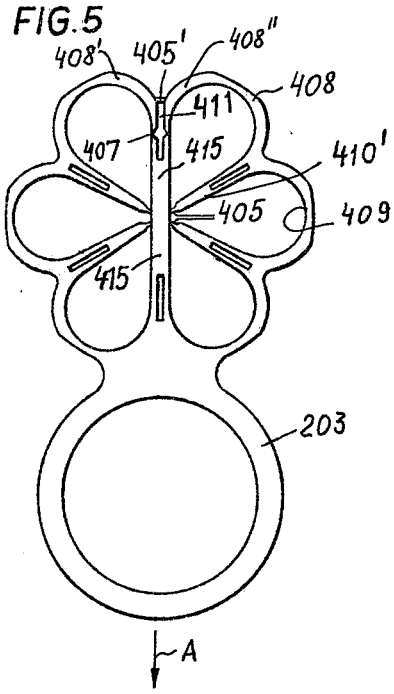

The embodiment of FIG. 4 functions in a similar fashion and has the ring 203 connected directly to the arcuate portions 314 forming the seats or pockets 309 with their flaring lugs 310 between them. Here, however, the two sections 308' and 308'' of the cartridge ring adjoin at the gap 311 at which they are interconnected by the intentional-rupture web 305. A tearing band 15 reaches from the ring 203 to the web 305 so that a tug upon the grip ring 203 pulls the strip 15 away and breaks the cartridge ring at the gap 311 so that the unit can be withdrawn from the array of cartridges. In the embodiment of FIG. 5 which is generally similar to that of FIG. 4 in that it has a tear strip 415 connected to the ring 203, the cartridge ring 408 is formed by the arcuate portions directly while the partition walls 410' between the seats or pockets 409 reach inwardly in a star configuration and are connected by intentional-break webs 405 with the strip 415. The strip 415, in turn, is connected to the remote arcuate members 408' and 408'' by weakening notches 407, these members being bridged, moreover, by an intentional-break web 405'.

When the ring 203 is withdrawn away from the array of cartridges and the latter are held in place by the cylinder of the revolver, the tear strip 415 breaks loose first, whereupon the gap 411 opens and the unit can be withdrawn.

Figure 6:
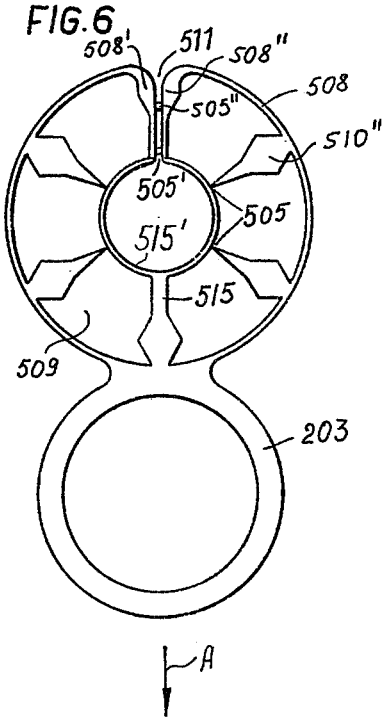

In the embodiment of FIG. 6, finally, the ring 203 is connected to a tension strip 515 which forms one of the walls defining the pockets 509 receiving the individual cartridges. In this case, the other walls 510'' are connected at weak junctions 505 with an inner ring 515' split at the gap 511 and connected to the members 508' and 508'' defining this gap by an intentional-break web 505'. The gap 511 can be spanned by another such web 505''.

When the ring 203 is gripped and pulled away from the array of cartridges, the ring 515' first breaks loose and collapses inwardly, whereupon the gap 511 opens to release the cartridges.

Naturally, all of the loading devices shown in FIGS. 3 through 6 can be injection molded directly around the cartridges or can be filled with the cartridges by axially inserting them into the respective pockets. The devices are effective for various weapon types, leave no pieces of material within the array of cartridges or on the cylinder, and provide packages of high stability before the units are torn apart. The units can also be pressed or bonded to the cartridges by the application of heat and pressure which can be effected during the swaging of the shell casing or other operations in the manufacture of the cartridge.

We claim:

1. A load package for a cylinder of a revolver, said cylinder having angularly equispaced bores adapted to receive respective cartridges, said package comprising:

an array of angularly spaced cartridges corresponding in number to said bores;

a circumferentially closed cartridge ring injection-molded onto said cartridges and formed with a plurality of angularly equispaced seats each receiving one of said cartridges, said cartridge ring having at least one weakened point whereby a force applied to said ring will rupture said ring at said weakened point; and a grip connected to said cartridge ring for applying force thereto to rupture said cartridge ring at said point and enable said cartridge ring to be withdrawn from said cartridges.

2. The package defined in claim 1 wherein said seats are open radially inwardly.

3. The package defined in claim 2 wherein said grip is a further ring connected to said cartridge ring.

4. The package defined in claim 3 wherein said weakened point is disposed adjacent said second ring.

5. The package defined in claim 4 wherein said cartridge ring is formed with a gap spanned by an intentional-break web at said point.

6. The package defined in claim 4 wherein a wall extends inwardly between each pair of adjacent seats, each of said walls being formed with a pair of inwardly divergent resilient lugs yieldably engageable with said cartridges.

7. A load package for a cylinder of a revolver, said cylinder having angularly equispaced bores adapted to receive respective cartridges, said package comprising:

an array of angularly spaced cartridges corresponding in number to said bores;

a circumferentially closed cartridge ring formed with a plurality of angularly equispaced seats each receiving one of said cartridges, said cartridge ring having at least one weakened point whereby a force applied to said ring will rupture said ring at said weakened point; and a grip connected to said cartridge ring for applying force thereto to rupture said cartridge ring at said point and enable said cartridge ring to be withdrawn from said cartridges, said seats being open radially inwardly and said grip being a further ring connected to said cartridge ring, said weakened point being disposed on said cartridge ring diametrically opposite said second ring.

8. The package defined in claim 7 wherein said cartridge ring is formed with a gap spanned by an intentional-break web at said point.

9. The package defined in claim 7 wherein a wall extends inwardly between each pair of adjacent seats, each of said walls being formed with a pair of inwardly divergent resilient lugs yieldably engageable with said cartridges.

10. A load package for a cylinder of a revolver, said cylinder having angularly equispaced bores adapted to receive respective cartridges, said package comprising:

an array of angularly spaced cartridges corresponding in number to said bores;

a circumferentially closed cartridge ring formed with a plurality of angularly equispaced seats each receiving one of said cartridges, said cartridge ring having at least one weakened point whereby a force applied to said ring will rupture said ring at said weakened point; and a grip connected to said cartridge ring for applying force thereto to rupture said cartridge ring at said point and enable said cartridge ring to be withdrawn from said cartridges, said seats being open radially inwardly and said grip being a further ring connected to said cartridge ring, said package further comprising a tear strip connected to said further ring and extending across said cartridge ring.

11. A load package for a cylinder of a revolver, said cylinder having angularly equispaced bores adapted to receive respective cartridges, said package comprising:

an array of angularly spaced cartridges corresponding in number to said bores;

a circumferentially closed cartridge ring formed with a plurality of angularly equispaced seats each receiving one of said cartridges, said cartridge ring having at least one weakened point whereby a force applied to said ring will rupture said ring at said weakened point; and a grip connected to said cartridge ring for applying force thereto to rupture said cartridge ring at said point and enable said cartridge ring to be withdrawn from said cartridges, said seats being open radially inwardly and said grip being a further ring connected to said cartridge ring, said package further comprising a pair of ligatures extending around said cartridge ring and connecting said further ring thereto.

12. A load package for a cylinder of a revolver, said cylinder having angularly spaced bores adapted to receive respective cartridges, said package comprising:

an array of angularly spaced cartridges corresponding in number to said bores;

a circumferentially closed cartridge ring formed with a plurality of angularly spaced seats each receiving one of said cartridges, said cartridge ring having at least one radial slit bridged by a ligature forming a second point whereby a force applied to said ring will rupture said ring at said second point; and a further ring forming a grip connected to said cartridge ring at a location diametrically opposite said slit for applying force to said cartridge ring adapted to rupture same at said point and enable said cartridge ring to be withdrawn from said cartridges.

13. A load package for a cylinder of a revolver, said cylinder having angularly spaced bores adapted to receive respective cartridges, said package comprising:

an array of angularly spaced cartridges corresponding in number to said bores;

a circumferentially closed cartridge ring formed with a plurality of angularly equispaced seats each receiving one of said cartridges;

a further ring forming a grip connected to said cartridge ring, said cartridge ring having a radial slit adjacent said further ring constituting a location at which said cartridge ring can be spread apart, said further ring being formed with a projection adjacent said slit, said cartridge ring having a recess on its periphery receiving said projection; and a ligature connecting said projection to said cartridge ring and forming a second point whereby a force applied to said further ring will rupture said ligature and enable spreading of said cartridge ring to permit said cartridge ring to be withdrawn from said cartridges.

* * * * *